US009462843B2

(12) United States Patent
Cormier et al.

(10) Patent No.: US 9,462,843 B2
(45) Date of Patent: Oct. 11, 2016

(54) CUSHIONING HELMET LINER

(75) Inventors: Joel M. Cormier, East Lathrup Village, MI (US); Donald S. Smith, Commerce Township, MI (US); Richard F. Audi, Dearborn, MI (US)

(73) Assignee: VICONIC DEFENSE INC., Dearborn, MI (US)

( * ) Notice: Subject to any disclaimer, the term of this patent is extended or adjusted under 35 U.S.C. 154(b) by 605 days.

(21) Appl. No.: 13/328,489

(22) Filed: Dec. 16, 2011

(65) Prior Publication Data

US 2013/0152286 A1 Jun. 20, 2013

(51) Int. Cl.
*A42B 3/12* (2006.01)
*A41D 13/015* (2006.01)

(52) U.S. Cl.
CPC ..... *A42B 3/124* (2013.01); *A41D 13/0156* (2013.01)

(58) Field of Classification Search
CPC ..... A42B 3/122; A42B 3/121; A42B 3/124; A41D 3/0156
USPC ..... 2/455, 459–467, 410–414
See application file for complete search history.

(56) References Cited

U.S. PATENT DOCUMENTS

| | | | |
|---|---|---|---|
| 1,784,511 | A | 12/1930 | Carns |
| 2,090,881 | A | 8/1937 | Wilson |
| 2,391,997 | A | 1/1946 | Noble |
| 3,011,602 | A | 12/1961 | Ensrud |
| 3,018,015 | A | 1/1962 | Agriss et al. |
| 3,071,216 | A | 1/1963 | Jones et al. |
| 3,196,763 | A | 7/1965 | Rushton |
| 3,231,454 | A | 1/1966 | Williams |
| 3,525,663 | A | 8/1970 | Hale |
| 3,605,145 | A | 9/1971 | Graebe |
| 3,938,963 | A | 2/1976 | Hale |
| 5,390,467 | A | 2/1995 | Shuert |
| 5,391,251 | A | 2/1995 | Shuert |
| 5,401,347 | A | 3/1995 | Shuert |
| 5,444,959 | A | 8/1995 | Tesch |

(Continued)

FOREIGN PATENT DOCUMENTS

| | | |
|---|---|---|
| EP | 0434834 A1 | 7/1991 |
| EP | 0630592 A1 | 12/1994 |
| EP | 1555109 A1 | 7/2005 |

OTHER PUBLICATIONS

International Search Report and Written Opinion; International application No. PCT/US2012/070006; date of mailing Feb. 15, 2013.

(Continued)

*Primary Examiner* — Shaun R Hurley
*Assistant Examiner* — Andrew W Sutton
(74) *Attorney, Agent, or Firm* — Brooks Kushman P.C.

(57) ABSTRACT

A liner system and method of thermoforming. A helmet has an energy absorbing inner system positioned inside the shell. The liner has thermoformed interconnected energy absorbing modules. At least some of the modules in the layer have a basal portion with upper and lower sections when viewed in relation to the wearer's head. The upper section has one or more energy absorbing units. At least some of the units are provided with a wall with a domed cap that faces the outer shell. The units at least partially cushion the blow by absorbing energy imparted by an object that impacts the outer shell. The lower comfort section has a tiered arrangement of layers. The layers are relatively compliant and thus provide a comfortable yet firm fit of the helmet upon the wearer.

21 Claims, 13 Drawing Sheets

(56) References Cited

U.S. PATENT DOCUMENTS

| | | | | |
|---|---|---|---|---|
| 5,470,641 | A | 11/1995 | Shuert | |
| 5,572,804 | A | 11/1996 | Skaja et al. | |
| 6,098,313 | A | 8/2000 | Skaja | |
| 6,199,942 | B1 | 3/2001 | Carroll, III et al. | |
| 6,247,745 | B1 | 6/2001 | Carroll, III et al. | |
| 6,453,476 | B1 | 9/2002 | Moore, III et al. | |
| 6,679,967 | B1 | 1/2004 | Carroll, III et al. | |
| 6,682,128 | B2 | 1/2004 | Carroll, III et al. | |
| 6,752,450 | B2 | 6/2004 | Carroll, III et al. | |
| 6,777,062 | B2 | 8/2004 | Skaja | |
| 7,328,462 | B1 | 2/2008 | Straus | |
| 7,360,822 | B2 | 4/2008 | Carroll, III et al. | |
| 7,377,577 | B2 | 5/2008 | Carroll, III et al. | |
| 7,404,593 | B2 | 7/2008 | Cormier et al. | |
| 7,625,023 | B2 | 12/2009 | Audi et al. | |
| 7,676,854 | B2 | 3/2010 | Berger et al. | |
| 7,766,386 | B2 * | 8/2010 | Spingler | 280/751 |
| 7,802,320 | B2 | 9/2010 | Morgan | |
| 7,895,681 | B2 | 3/2011 | Ferrara | |
| 7,908,678 | B2 | 3/2011 | Brine, III et al. | |
| 7,954,177 | B2 | 6/2011 | Ide et al. | |
| 7,958,573 | B2 | 6/2011 | Lewis, Jr. et al. | |
| 8,402,568 | B2 | 3/2013 | Alstin et al. | |
| 8,510,863 | B2 | 8/2013 | Ferguson | |
| 8,528,118 | B2 | 9/2013 | Ide et al. | |
| 8,528,119 | B2 | 9/2013 | Ferrara | |
| 8,548,768 | B2 | 10/2013 | Greenwald et al. | |
| 8,566,988 | B2 | 10/2013 | Son et al. | |
| 2002/0017805 | A1 * | 2/2002 | Carroll et al. | 296/189 |
| 2008/0120764 | A1 | 5/2008 | Sajic | |
| 2010/0244469 | A1 | 9/2010 | Gerwolls et al. | |
| 2010/0299812 | A1 | 12/2010 | Maddux et al. | |
| 2013/0061375 | A1 * | 3/2013 | Bologna et al. | 2/414 |
| 2013/0152287 | A1 * | 6/2013 | Cormier et al. | 2/459 |
| 2014/0173812 | A1 * | 6/2014 | Krueger | 2/455 |

OTHER PUBLICATIONS

International Preliminary Report on Patentability; International application No. PCT/US2012/070006; date of issuance of report Jun. 17, 2014.

Brachmann, Steve, "Concussion Science, Stagnant Helmet Innovation and the NFL"; IPWatchdog.com; Feb. 2, 2014.

* cited by examiner

CUSHIONING HELMET LINER

BACKGROUND OF THE INVENTION (1) Field of the Invention

One aspect of the invention relates to an impact-absorbing helmet with a compliant liner system that absorbs energy generated by an impacting force exerted on the outside of the helmet.

(2) Description of Related Art

Helmets and hard hats have been used for centuries in all types of activity where there is a risk of blunt force trauma to the head. These helmets will typically consist of three layers. The outer shell layer functions to protect the head from lacerations and abrasions from the incident object impacting the helmet. A comfort layer, which contacts the skull of the wearer, typically provides some level of padding to improve comfort and fit of the assembly to the skull. Interposed between the shell and the comfort layer, an energy absorbing system is often utilized to mitigate some of the impacting forces from the blunt force trauma.

In recent years, Mild Traumatic Brain Injury (MTBI) and concussions have gained more attention since the occurrence of these events do not seem to be decreasing markedly as the helmet technology has improved. Athletes, soldiers, and workers involved in one or more impact events often have short term or permanent loss of brain function as a result of these impact events. NOCSAE, FMVSS, and other helmet system performance standards have sought to improve the performance of helmet systems to reduce the severity of an impact event. However, consumers desire a helmet that not only protects them but one that is also aesthetically pleasing, non-restrictive, light weight, comfortable, breathable, safe, durable, and affordable. A helmet may provide exceptional impact protection but if it looks, smells, or feels uncomfortable then no one will wear it.

Helmet manufacturers such as Riddell, Schutt, CCM, Brine, Skydex, Gentex and the like provide helmet systems for various occupations and recreational sports. The outer shell of the helmet is designed in such a way that it protects the wearer from cuts and abrasions from the incident object. These shells are typically thermoplastic or thermoset composites that are extremely tough and rigid. During an impact event, the shell itself does absorb some of the impact energy by flexing in response to the impacting object. However, the majority of the impacting force is transferred from the shell into the shell cavity where the energy absorbing and comfort layers reside and ultimately are transferred to the wearer. This force transfer without significant absorption often presents a risk of injury.

Traditionally, the energy absorbing layer in the shell has been some type of foam assembly. The assembly may be comprised of one or more layers or grades of foam to provide both comfort and impact protection. The inner layer is typically lower in density and provides less energy absorbing contribution than the more rigid outer layer. Furthermore, some systems, such as Riddell's Revolution football helmet, also employ a bladder system that allows the wearer to customize the fit of the helmet to the skull based on the level of liner inflation. While these systems may be comfortable to wear, foam lacks energy absorbing efficiency. Furthermore, foam does not breathe well and its solid construction allows minimal room for airflow to cool the head.

More recently, helmet manufactures have been developing helmet liner systems constructed with a tougher energy absorbing layer made from thermoplastic resins. These materials are typically injection molded or twin sheet thermoformed as an energy absorbing layer. A separate system is utilized to provide comfort to the wearer. The energy absorbing structures, by design, are rigid and uncomfortable. One or more layers of comfort foam or padding is typically added to the assembly. This increases the cost of these systems. Furthermore, the manufacturing methods employed to produce the energy absorbing layer do not allow for a high degree of design flexibility to optimize performance.

Among the prior art considered in preparing this patent application is:

| Assignee Name | U.S. Pat. No./ application Ser. No. | Technology |
|---|---|---|
| Riddell | 7,954,177 | Foam |
| Brine | 7,908,678 | Foam |
| Xenith | 7,895,681 | TPU |
| Team Wendy | 6,453,476 | Foam |
| Gentex | 7,958,573 | Foam |
| Morgan | 7,802,320 | Foam |
| Crescendo | 7,676,854 | Plastic |
| Skydex | 6,777,062 | TPU |

Additionally, several of Applicant's patents (see, e.g., U.S. Pat. Nos. 6,199,942; 6,247,745; 6,679,967; 6,682,128; 6,752,450; 7,360,822; 7,377,577; 7,404,593; 7,625,023 which are incorporated herein by reference) describe an efficient modular tunable energy absorbing assembly for reducing the severity of an impact event.

BRIEF SUMMARY OF THE INVENTION

In one embodiment of the invention, there is a helmet with an outer shell and an energy absorbing layer positioned inside the shell. The layer has a cluster of thermoformed interconnected energy absorbing modules. At least some of the modules in the layer have a basal portion with upper and lower sections when viewed in relation to the wearer's head. Thus, the upper section is closest to the outer shell of the helmet while the lower section is closest to the wearer's head. Thus, the upper section is positioned toward the inner surface of the outer shell and the lower section lies closer to the head of a wearer.

Preferably the upper section has one or more energy absorbing units. At least some of the units are provided with a substantially frustoconical wall with a domed cap that in some embodiments faces the head of the wearer. The units at least partially cushion the blow by absorbing energy imparted by an object that impacts the outer shell. If desired, one or more ribs interconnect at least some of the energy absorbing units in one or more modules.

In some embodiments, the lower section has a tiered arrangement of layers. An outermost layer cooperates with and lies inside a periphery of the upper section. One or more intermediate layers extend from and within the outermost layer. An innermost layer extends from and within an intermediate layer. The layers are relatively compliant and thus provide a comfortable yet firm fit of the helmet upon the wearer, At least some of the innermost layers are provided with an aperture that reduces weight and allows air within the clusters to bleed therefrom.

DETAILED DESCRIPTION OF THE PREFERRED EMBODIMENTS

Figure 1:
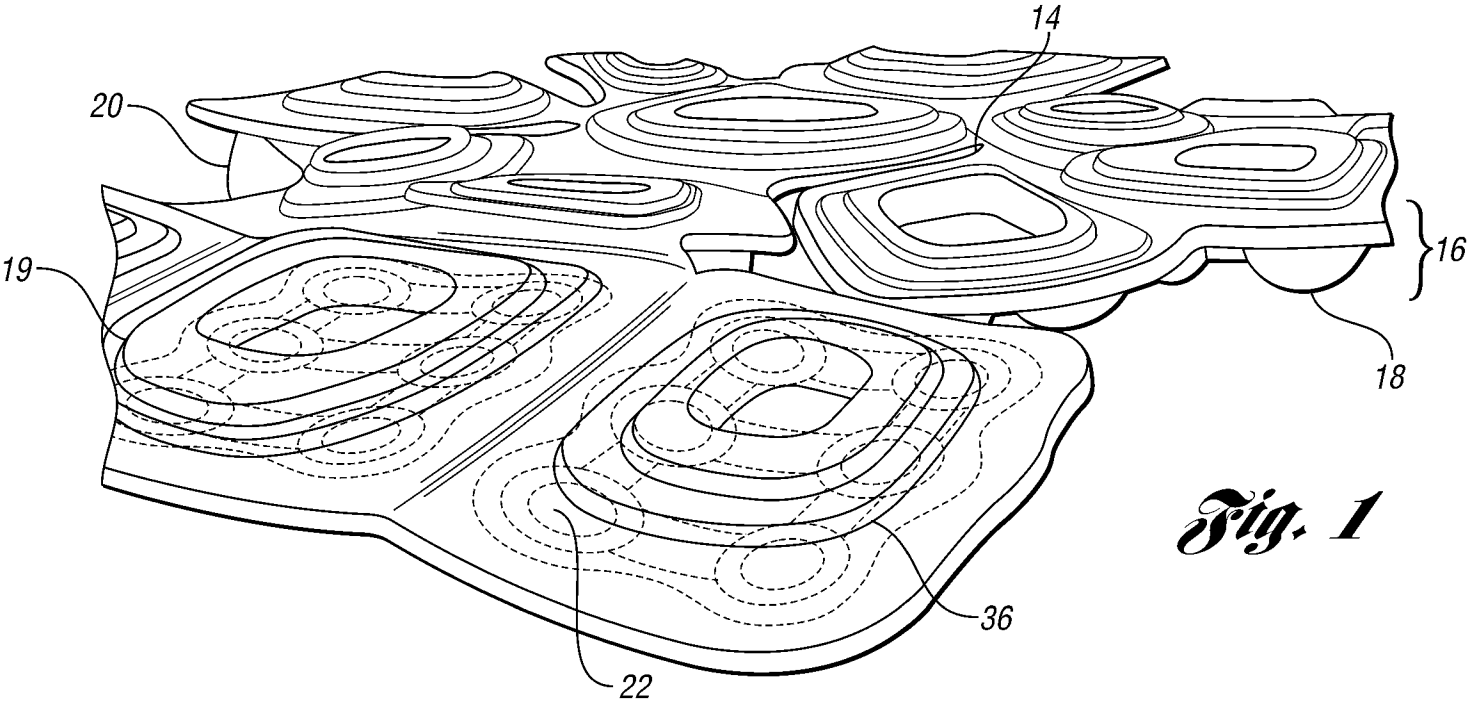
FIG. 1 is a perspective of one illustrative embodiment of an energy absorbing liner.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

In one embodiment of the invention (FIGS. 12-14), there is an incident surface such as a helmet 10 with an outer shell 12 that meets an impacting or impacted object. Other incident surfaces include for example, an automotive headliner, a knee bolster, a bumper and a steering wheel, plus various personal protectors, such as an elbow guard, a shoulder pad, an abdominal protector, a knee pad, and a wrist pad. An energy absorbing (EA) layer or liner system 14 is positioned inside the shell 12. The layer 14 has an assembly of thermoformed energy absorbing modules 16 that either nestle together (like a jigsaw puzzle) or are interconnected. At least some of the modules 16 in the layer 14 have upper and lower basal portions 18-19 with upper 20 and lower 22 sections when viewed in relation to the wearer's head 24. Thus, the upper section 20 is closest to the outer shell 12 of the helmet 10 while the lower section 22 is closest to the wearer's head 24. Thus, the upper section 22 is positioned toward the inner surface 26 of the outer shell 12 and the lower section 22 lies closer to the head 24 of a wearer.

Figure 12:
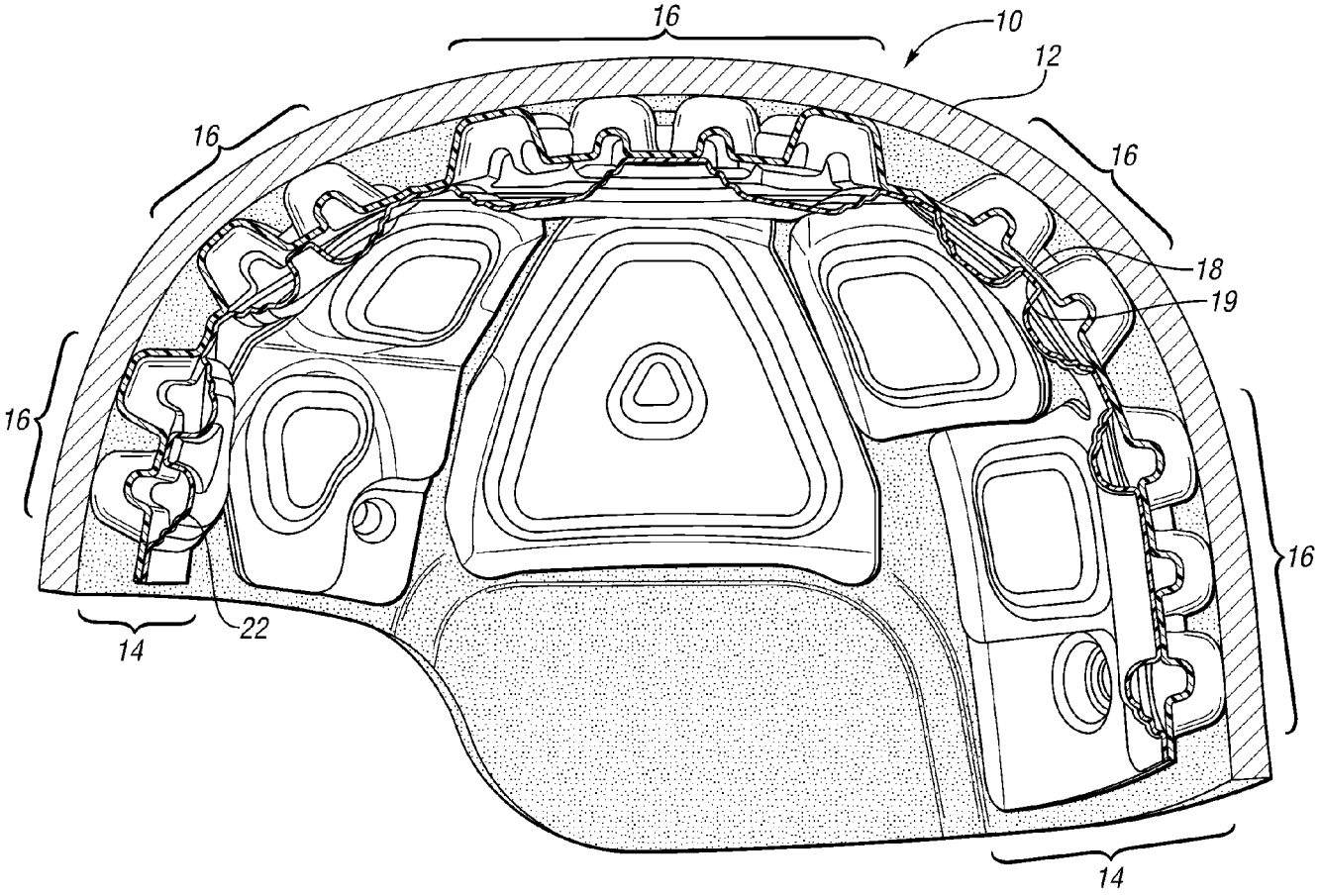
FIG. 12 is a vertical longitudinal cross-sectional view of a helmet-liner assembly.
Figure 13:
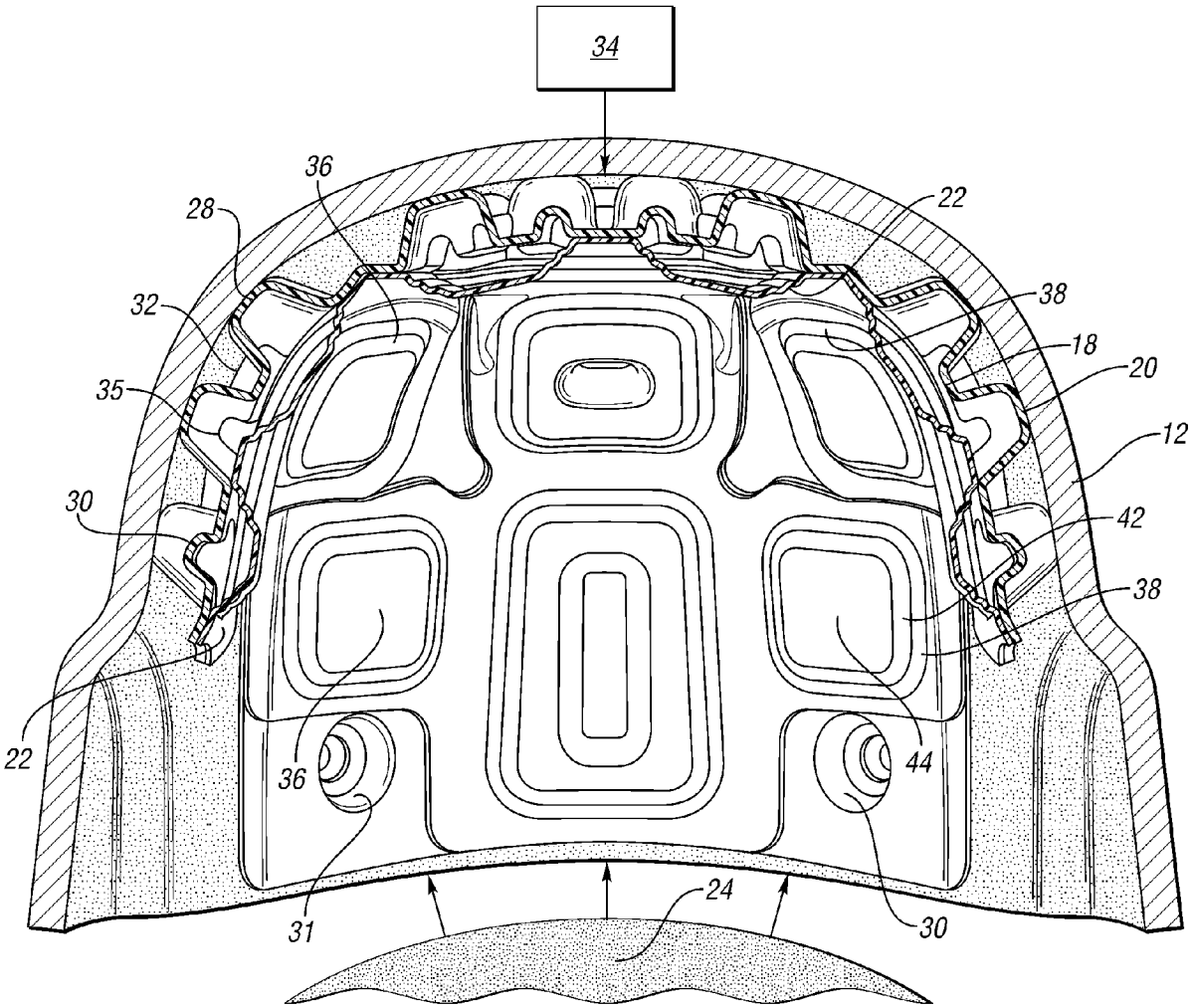
FIG. 13 is a vertical lateral sectional view of the helmet-liner assembly.
Figure 14:
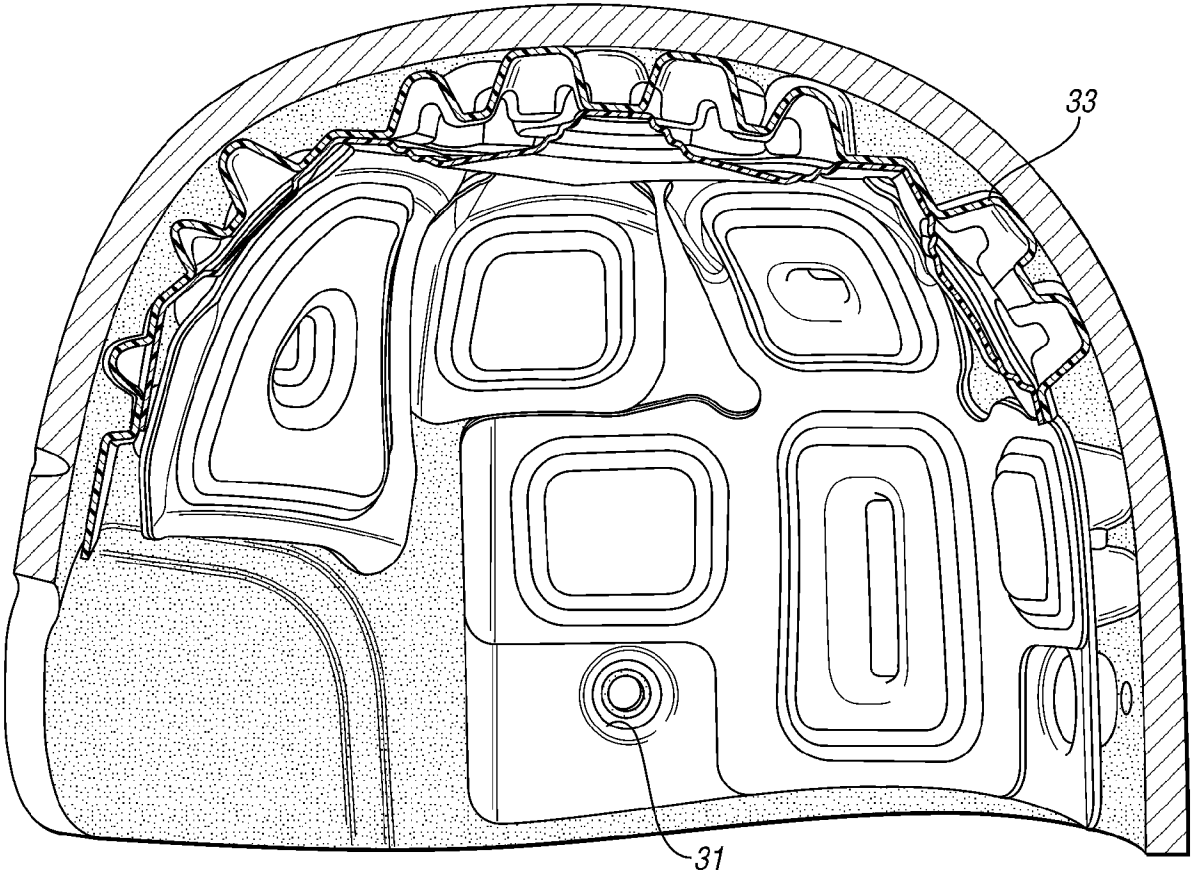
FIG. 14 is another vertical longitudinal perspective view of an embodiment of the invention.

Preferably the upper section 20 has one or more energy absorbing units 28 (FIGS. 12-14). At least some of the units 28 are provided with a rounded wall 30 that in some embodiments is substantially frustoconical with a domed cap 32 that lies atop the head 24 of the wearer. The wall 30 and the upper basal layer 18 define a perimeter 31 where they intersect, the perimeter 31 having a shape that is selected from the group consisting of a circle, an oval, an ellipse, an oblate oblong, a polygon, a quadrilateral with rounded edges and combinations thereof. Wall 30 has an upper edge 33 that meets the dome 32, the upper edge defining a perimeter where they intersect. That perimeter defines a shape that is selected from the group consisting of a circle, an oval, an ellipse, an oblate oblong, a polygon, a quadrilateral with rounded edges and combinations thereof. The units 28 at least partially cushion the blow by absorbing energy imparted by an object 35 that impacts the outer shell 12. If desired, one or more ribs 34 interconnect at least some of the energy absorbing units 28 in one or more modules 16.

Figure 3:
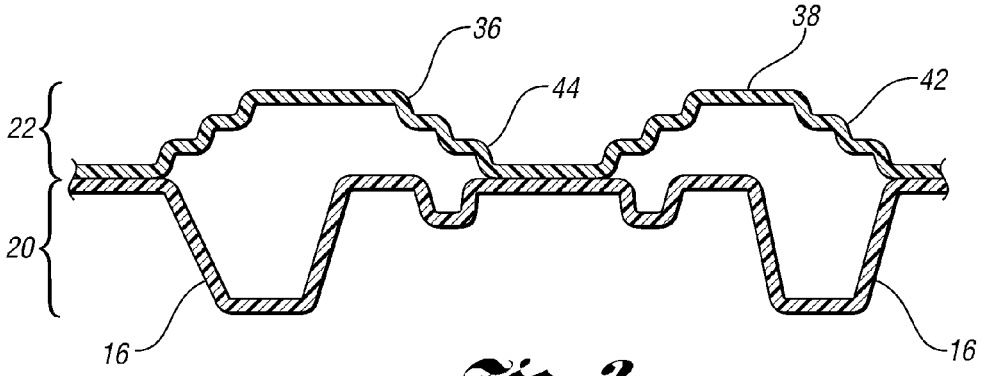
FIG. 3 is a vertical section for a typical energy absorbing module.

In some embodiments, the lower section 22 has a tiered arrangement of layers 36 (FIG. 3). An outermost layer 38 cooperates with and lies inside a periphery 40 of the lower section 22. One or more intermediate layers 42 extend from and within the outermost layer 38. An innermost layer 44 extends from and within an intermediate layer 42. The layers 38, 42, 44 are relatively compliant and thus provide a comfortable yet firm fit of the helmet upon the wearer. If desired, the layers 38, 42, 44 may be imbued with a gradation of stiffness that presents a progressive change in cushioning characteristics across the lower section 22.

At least some of the innermost layers 38, 42, 44 are provided with an aperture 46 (FIG. 4) that reduces weight and allows air within the modules 16 to bleed therefrom. Thus, the recesses created by the bellowed structure 38, 42, 44 depicted in FIG. 3 provide areas where perforations or apertures 46 may be introduced to allow air flow and improve the convective cooling of the head. Similarly, the EA (upper) layer 20 may also be perforated or vented to maximize air flow within the shell. Supplemental air flow may also be created between the two layers 16, 22 by employing additional ribbing or channels and provide drainage locations for cleaning purposes. These additional air flow channels are also anticipated to reduce the blast pressures the wearer's head would experience in an impacting event.

One aspect of the invention thus includes a helmet 10 and a helmet liner system 12 that, when engineered for a given set of impact conditions, will provide a mass optimized helmet liner 12 with superior impact protection, fit, comfort, breathability, and durability at a reasonable cost.

By modifying the shape and orientation of energy absorbing (EA) modules, the resistance of the energy absorber 14 can be tuned to optimize performance around the entire helmet shell 12. The global stiffness of the absorber 14 can also be tuned by running thinner or thicker sheet off a thermoforming tool to soften or stiffen the absorber respectively. Additionally, unlike foam, the EA layer is not solid and has superior cooling characteristics.

In one embodiment (FIGS. 12-14), the lower section 22 of layers 36 of comfort material is attached to the upper section 20 by conventional joining processes. The EA 20 and comfort 22 layers are attached together using traditional plastic joining technologies such as welding and adhesives. But the lower section 22 may or may not be attached to the upper section 20.

In a preferred embodiment, the comfort layer 22 is manufactured from the same material as the EA (upper) layer 20. While several resin candidates have been identified, thermoplastic urethanes (TPU's) have proven to be the most resilient and chemically resistant. There are various grades and manufacturers of TPU. Lubrizol's Estane ETE55DT3 is a desirable material based on resiliency and energy absorbed per unit mass based on performance testing conducted to date. The thickness of the comfort layer 22 is preferably less than or equal to the thickness of the EA layer 20. In one embodiment, as mentioned earlier, the comfort layer 22 has bellowed or tiered structures 36 (like an inverted wedding cake) facing in one or more directions. These structures 36 act like an accordion with bellows (but preferably non-pneumatically) or flex in response to an applied load. If desired, the liner system 10 could be manufactured by twin sheet thermoforming.

Anticipated uses for the disclosed this technology include but are not limited to helmets for soldiers, athletes, workers and the like, plus automotive applications for protecting a vehicle occupant or a pedestrian from injury involving a collision. It is also anticipated that this technology could be applied anywhere that some level of comfort is required in an energy absorbing environment including all types of padding, flooring, cushions, walls, and protective equipment in general. Optionally, the comfort layer 22 could be at least partially inflated primarily for fit.

Figure 2:
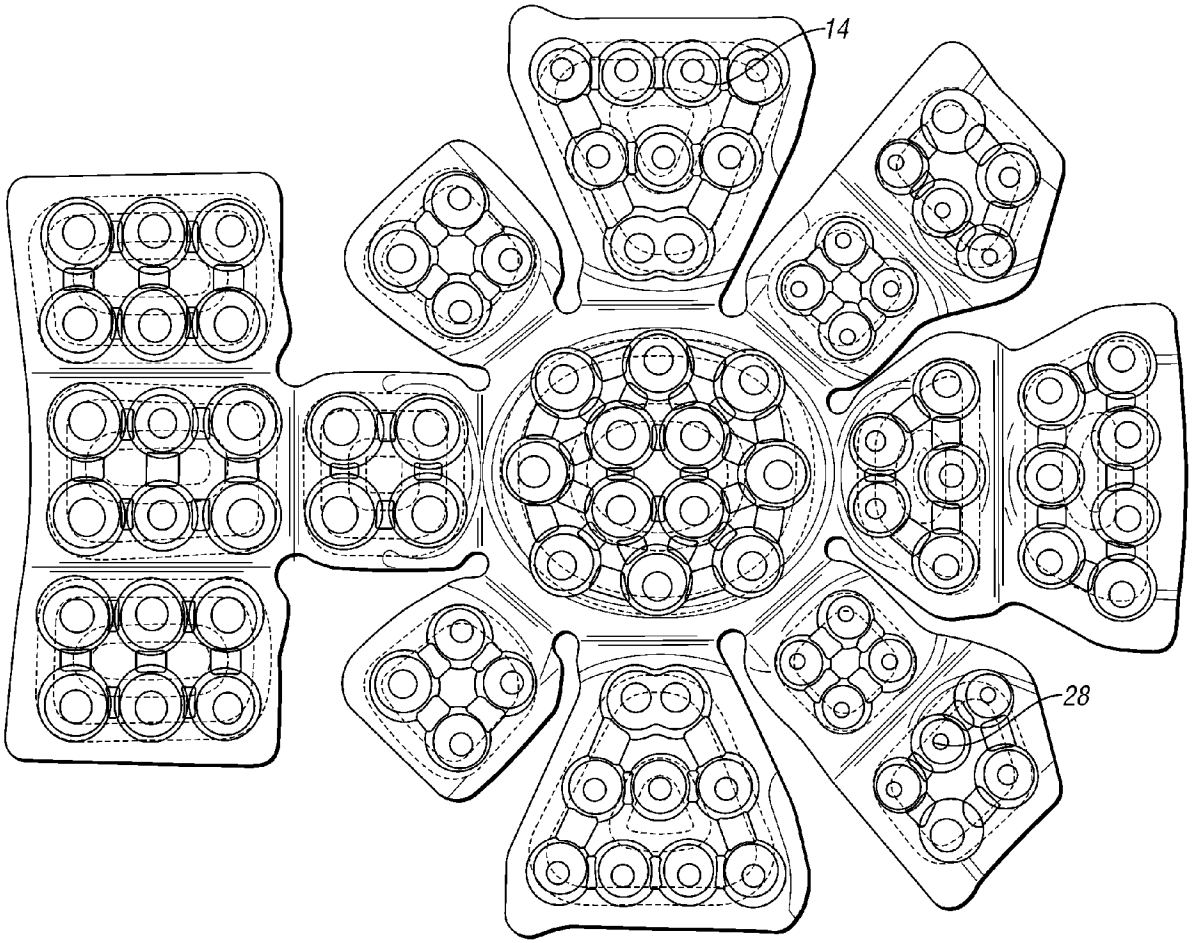
FIG. 2 is a bottom plan view of a bottom (cushioned) section of liner that is flattened before installation, for example, in a helmet.

FIG. 1 is a perspective view of one illustrative embodiment of the invention—an energy absorbing liner 14 for an advanced combat helmet 12. In FIG. 2, the darkened portions represent areas where tiered layers 36, or inverted wedding cake-like structures, bellows, or undulations are engineered for flexibility and comfort. In this embodiment, the darkened areas represent surfaces that would contact the wearer's head. Optionally, a supplemental layer of comfort padding or material may be added to these areas if the fit needs to be customized or the wearer determines that the plastic contact surface is not as comfortable as desired.

In most embodiments, the liner system 14 includes a plurality of interconnected modules 16. FIG. 3 is a section through a typical energy absorbing module 16. These modules 16 may have zero to multiple undulations (to be described) based upon the performance and comfort characteristics desired in a given liner system 14 or module 16.

Figure 5:
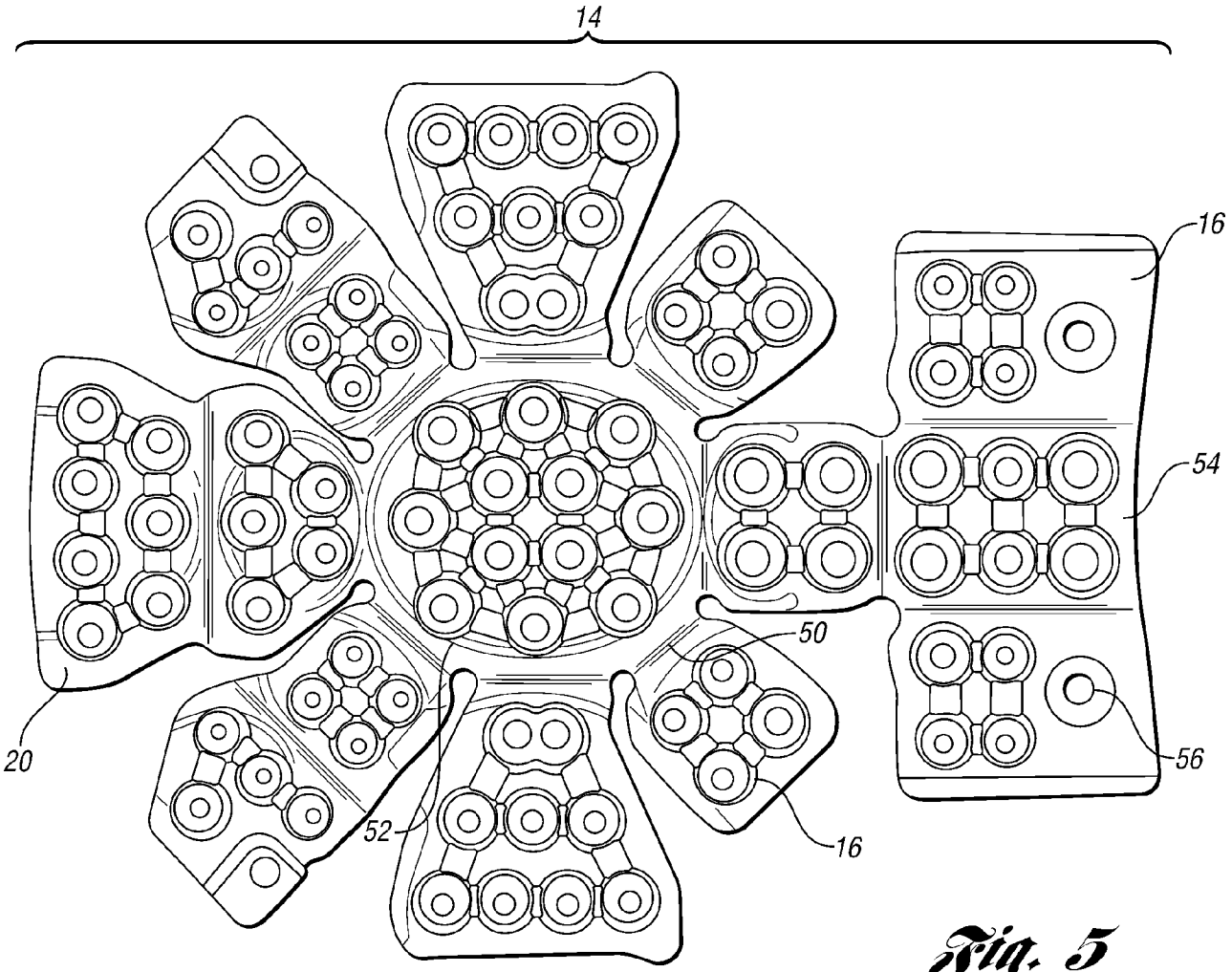
FIG. 5 illustrates a preferred embodiment of an energy absorbing upper section of the liner system, which in the embodiment shown is a one-piece construction of interconnected modules.

Continuing with the primary reference to FIG. 5, a living hinge 50 joins at least some adjacent modules 16 in the upper section 20 of the energy absorbing layer 14. A dome module 52 lies atop the crown of the head of a wearer. At least one satellite module grouping 54 connects with and extends from the dome module 52. At least one of the satellite module grouping 54 comprises one or more modules 16 that are adjoined to each other and to the dome module 52.

Figure 4:
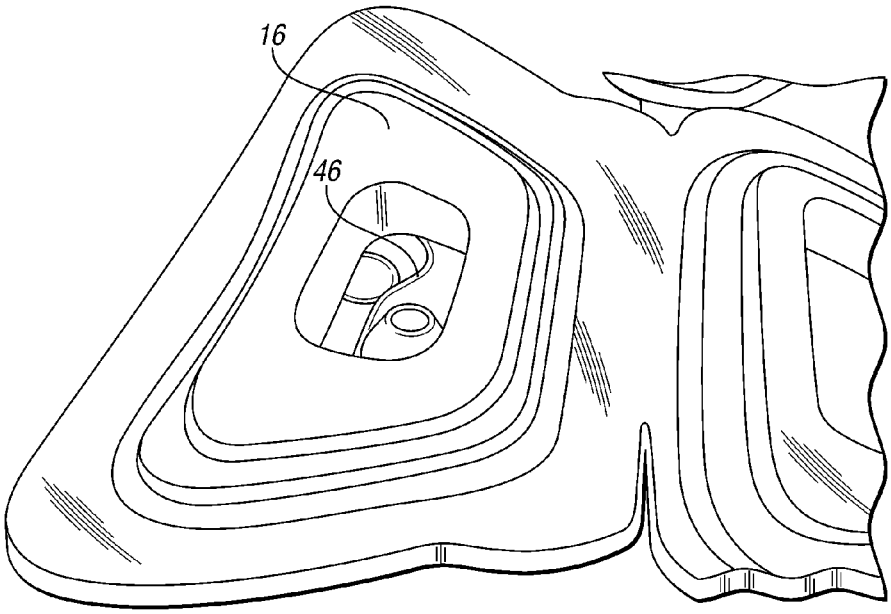
FIG. 4 illustrates one enlarged example of a pair of clusters in a lower section of energy absorbing liner that are interconnected.

FIG. 4 illustrates one enlarged example in which adjacent energy absorbing modules 16 are interconnected.

Traditionally, hook and loop materials of adhesive have been utilized to attach the helmet liner 14 to the helmet shell 12. Also anticipated is the use of other means for attaching such as rivets, coined snaps, add-on fasteners, tape, Velcro® and glue to affix the liner to the shell.

Shown as an example in FIG. 5 is the energy absorbing portion 16 of an advanced combat helmet liner. A preferred embodiment of the EA portion depicted in FIG. 5 is a one piece construction of interconnected modules 16. Fewer attachments and components are necessary to adhere the helmet liner 14 to the helmet shell 12 partially because the modules 16 tend to afford mutual support and assure predictable placement in relation to the helmet 10. Attachment holes 56 can also be provided in one or more sections 20, 22 of the assembly and offer an additional way to adhere the liner 14 to the helmet shell 12.

Helmet systems are designed to absorb and mitigate some of the blunt forces or blast energy from an event. Initial testing of one embodiment indicates that superior impact performance can be obtained when compared to the prior art. This enables a helmet system to be realized that is safer than those which preceded it.

The impact performance of the disclosed system may be tuned or optimized to the skill level of the athlete for recreational sporting helmets. Youth sporting equipment may be less stiff (e.g., formed from a thinner gage of material) and tuned to the speed and mass of the athlete. Professional athletes may require a stiffer absorber due to their increased mass, speed, and aptitude.

Furthermore, the preferred embodiment of the liner system is a one piece construction. This design requires fewer components to assemble. This attribute reduces the assembly labor, cost, complexity, and number of purchased components.

Additionally, the assembly is often lighter in weight and more comfortable than the prior art.

The materials of construction are also more resilient to repeat impacts when compared to the prior art.

Additional air flow through the helmet liner improves head cooling and provides some level of increased protection from blast events when compared to the prior art.

Further, the liner system 14 is quite easy to clean and has improved chemical resistance compared to many products found in the prior art.

Figure 6:
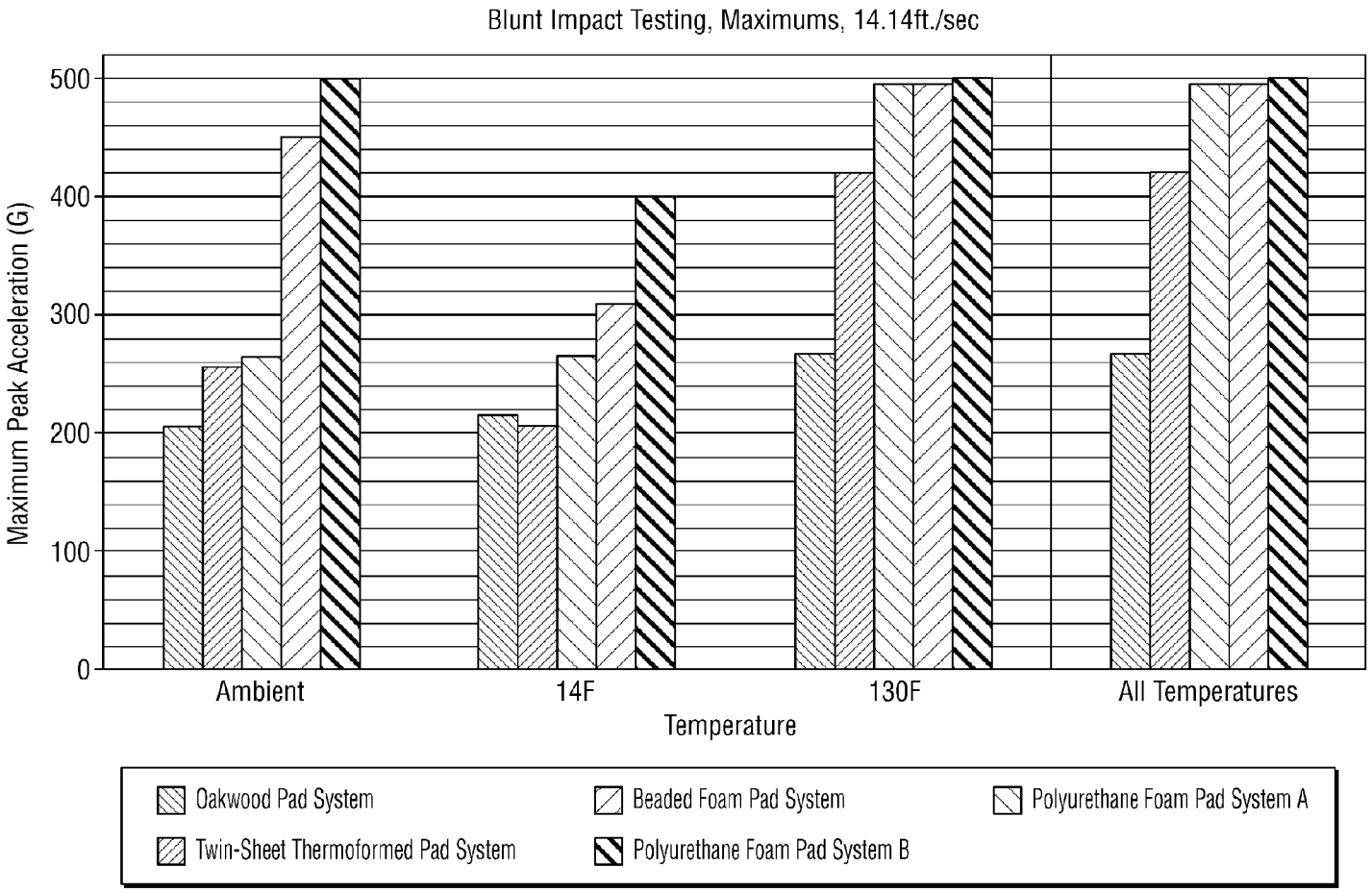
FIG. 6 is a graph comparing the blunt impact performance of one example of the inventive recoverable energy absorber compared to the prior art as a function of temperature.
Figure 7:
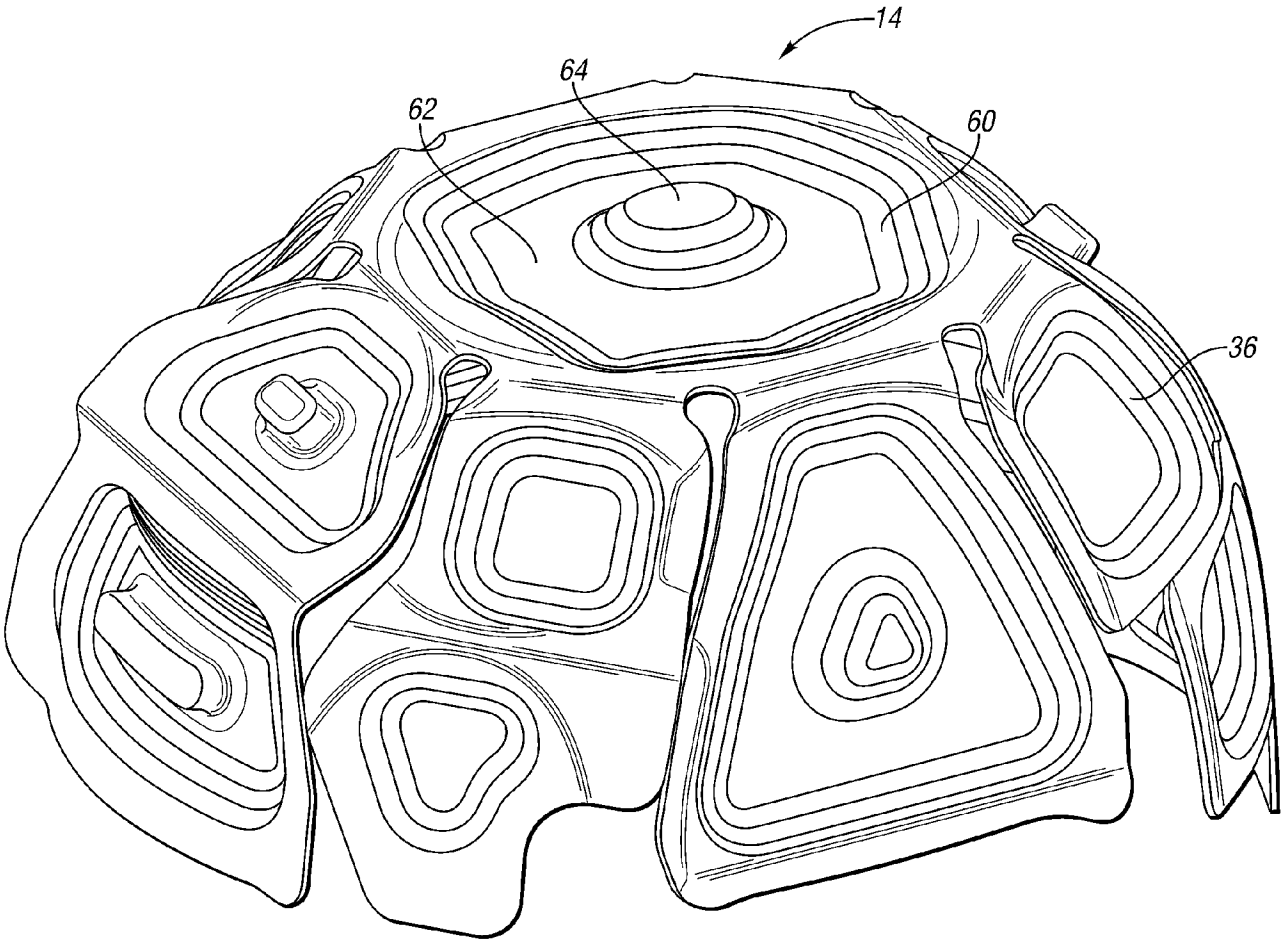
FIG. 7 is a quartering perspective view of a liner system with the helmet not shown, in which a portion that faces the forehead of the wearer appearing on the lower left side.
Figure 8:
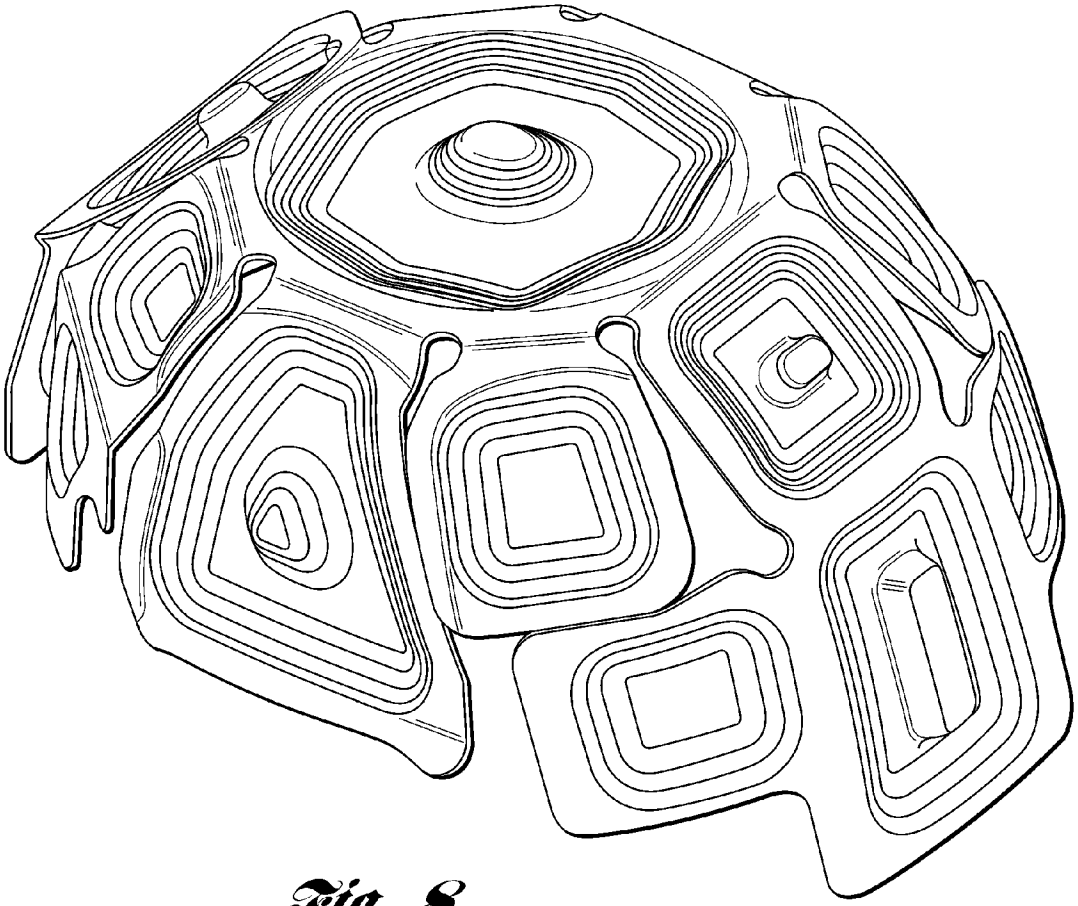
FIG. 8 resembles the view of FIG. 7, taken from a different vantage point, in which the portion which interfaces with the back of the wearer's head appears in the lower right side.
Figure 9:
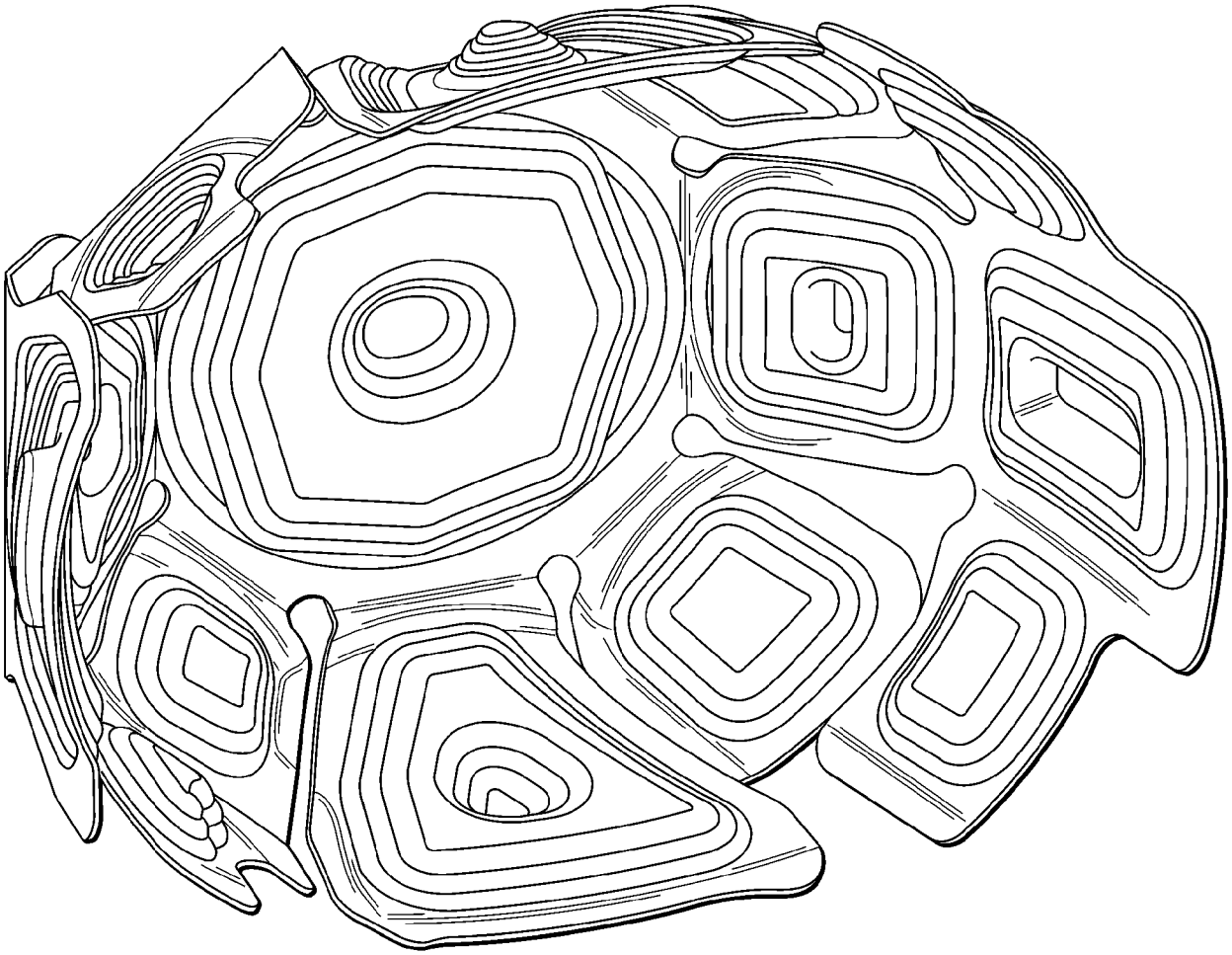
FIG. 9 illustrates an inside of the liner system when viewed upwardly—the rear head portion is on the left, and the neck portion lies on the right.
Figure 10:
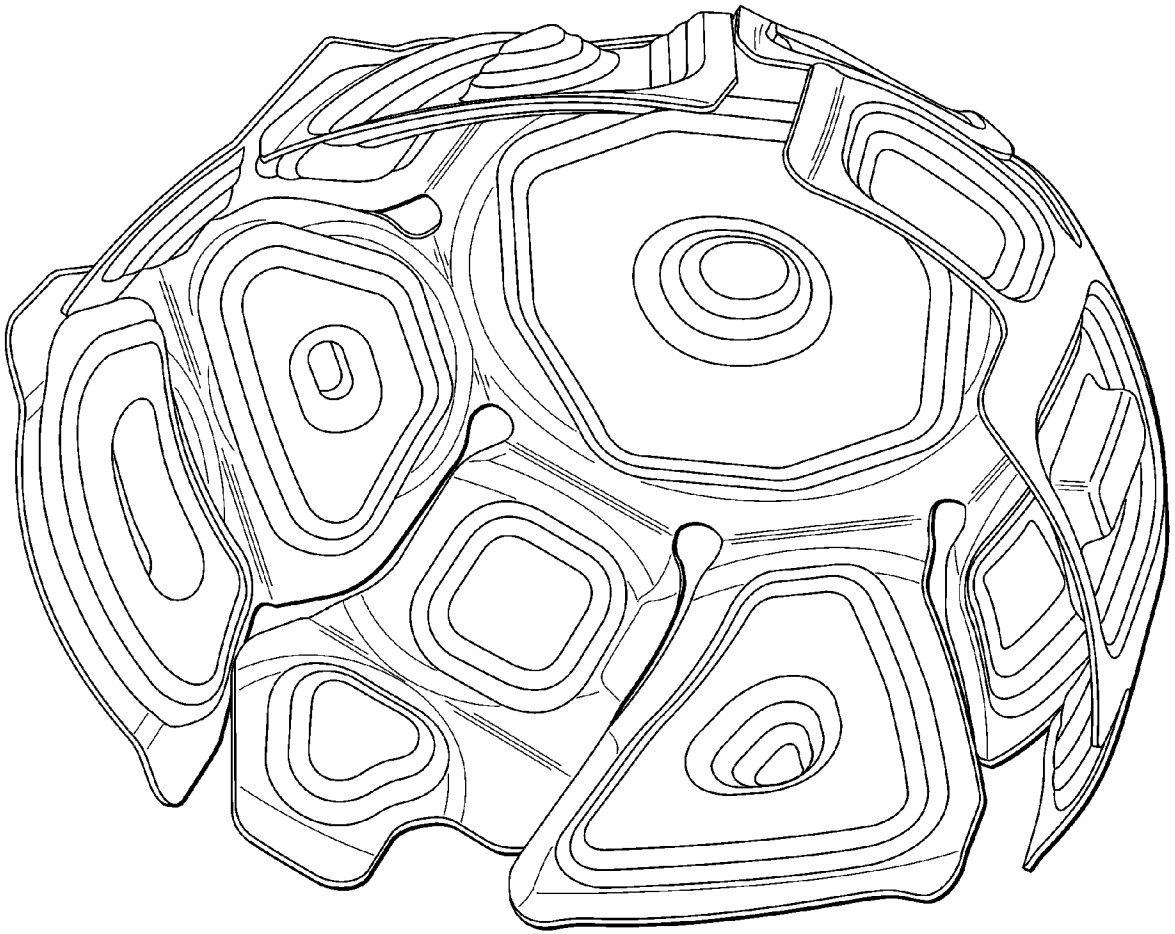
FIG. 10 resembles the view of FIG. 9 but from a shifted vantage point.

It is thought that the overall system performance (and cost) is anticipated to be near the best in the industry based on market analysis completed to date. Shown in FIG. 6 is a graph comparing the blunt impact performance of one example of the inventive recoverable energy absorber 14 compared to the prior art as a function of temperature. The graph of FIG. 6 indicates that over all tested temperatures, the maximum forces experienced by the head of a wearer provided with an inventive pad system 14 is substantially less than experienced using other technologies when exposed to comparable impacting forces. Lower peak accelerations provide a better chance of avoiding serious injury or death.

It is also anticipated that in some instances, it may be desirable to pressurize one or more modules 16 to customize the fit of the absorber to the wearer.

Comfort layers of cloth or material may also be introduced between the absorber and the head to improve comfort such as a "Doo Rag" (a piece of cloth used to cover the head).

Further, the Applicant's pending soft top technology may also be employed to minimize the potential for unwanted noise (BSR) from the assembly. See e.g., U.S. Ser. No. 12/729,480 and Ser. No. 13/155,612 which are incorporated herein by reference.

FIGS. 7-11 illustrate various aspects of the lower section 22 of the liner system 14. The liner system 14, as mentioned earlier, has a tiered arrangement of layers 36. The layers 36 include an outer stepped region 60, a floor 62 upon which the outer step region 60 terminates and an inner region 64 that extends from the floor 62. In some embodiments, the inner region 64 is also provided with a tiered arrangement of layers.

Figure 11:
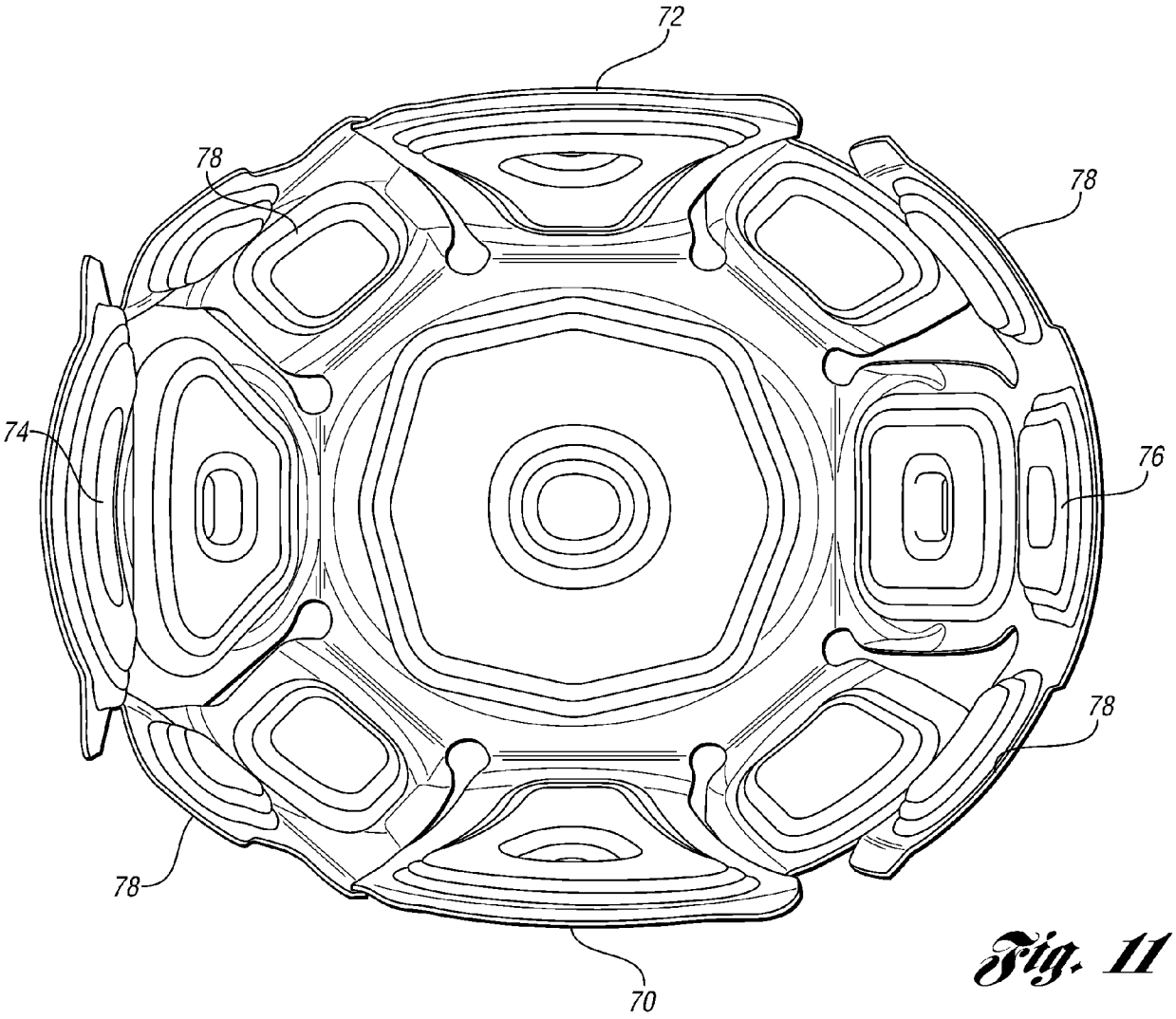
FIG. 11 resembles the view of FIG. 10.

Turning now to FIG. 11, it will be appreciated that some of the comfort clusters include one or more side clusters 70, 72 that at least partially cover the ears of the wearer. One or more back clusters 74 at least partially cover the back of a wearer's head. One or more front clusters 76 at least partially cover a wearer's forehead. If desired, one or more interstitial clusters 78 may lie between the side, front and back clusters.

In some applications, it may be desirable to orient the upper section 20 so that the energy absorbing units 28 face downwardly and the upper basal layer is juxtaposed with the helmet. In such configurations, the lower basal layer of the lower section is adjoined to the upper basal layer of the upper section.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An energy absorbing liner system positioned between an incident surface that meets an impacting object and a mass to be at least partially protected, the liner system including a plurality of energy absorbing modules that are detachably attached to the incident surface, each module being interconnected with one or more neighboring modules by one or more living hinges, the modules affording mutual support and providing predictable placement in relation to the incident surface, at least some of the modules having an upper section with an upper basal layer one or more frustoconical energy absorbing units that alone provide energy absorption between the incident surface and a lower section, the energy absorbing units extending from the upper basal layer towards the incident surface, at least some of which units being provided with a wall that slopes inwardly from the upper basal layer towards the incident surface and an imperforate cap that extends across the wall proximate the incident surface;

the lower section at least partially interfacing with the upper section, the lower section having a lower basal layer that at least partially interfaces with the upper basal layer, a tiered arrangement of layers extending from the lower basal layer, the arrangement including a radially outermost layer that cooperates with and lies inside a perimeter of the lower section, one or more radially intermediate layers extending from and within the outermost layer and a radially innermost layer that extends from and within an intermediate layer and lies adjacent to the mass to be protected, the layers in the tiered arrangement being relatively compliant and providing a comfortable yet firm fit of the liner system in relation to the mass to be protected.

2. The liner system of claim 1, wherein the incident surface that meets the impacting object is a helmet.

3. The liner system of claim 1, wherein the upper layer, the lower layer or both are made by thermoforming and are joined by uniting at least a part of the upper and lower basal layers.

4. The liner system of claim 1, wherein the cap is domed.

5. The liner system of claim 1, further including one or more ribs that extend between at least some of the energy absorbing units.

6. The liner system of claim 1, wherein an innermost layer of the lower section defines an aperture.

7. The liner system of claim 1, wherein the liner system is configured to protect the head of a wearer, the system further including a dome module that lies atop the crown of the head of the wearer.

8. The liner system of claim 7, further including at least one satellite module grouping that connects with and extends from the dome module.

9. The liner system of claim 8, wherein the at least one of the satellite module grouping comprises one or more modules that are adjoined to each other and to the dome module.

10. The liner system of claim 1, wherein the number of intermediate layers equals one.

11. The liner system of claim 1, further including attachment holes defined in upper and lower basal layers for attaching the liner system to the incident surface that meets the impacting object.

12. The liner system of claim 1, wherein the tiered arrangement of layers in the lower section includes comfort clusters, at least some of the clusters each having:

an outer stepped region;

a floor upon which the outer stepped region terminates; and an inner region that extends from the floor.

13. The liner system of claim 1, wherein some of the modules include a pair of side clusters that are configured to at least partially cover the ears of a wearer;

one or more back clusters that are configured to at least partially cover the back of a wearer's head; and one or more front clusters that are configured to at least partially cover a wearer's forehead.

14. The liner system of claim 1 wherein each frustoconical wall has a lower perimeter that lies proximate the incident surface and a basal perimeter where the wall meets the upper basal layer, each lower perimeter being shorter than the associated upper perimeter.

15. The liner system of claim 1 wherein the wall and the upper basal layer define a perimeter where they intersect, the perimeter defining a shape that is selected from the group consisting of a circle, an oval, an ellipse, an oblate oblong, a polygon, a quadrilateral with rounded edges and combinations thereof.

16. The liner system of claim 4 wherein the wall has an upper edge that meets the incident surface, the upper edge defining a perimeter where they intersect, the perimeter defining a shape that is selected from the group consisting of a circle, an oval, an ellipse, an oblate oblong, a polygon, a quadrilateral with rounded edges and combinations thereof.

17. The liner system of claim 13, further including interstitial clusters that lie between at least some of the side, front and back clusters.

18. The liner system of claim 1, further including one or more attachment holes that are provided in one or more of the lower and upper sections that offer a way to adhere the liner system to the helmet.

19. The liner system of claim 1, wherein the liner system is attached to a helmet shell by means for attaching, including but not limited to, rivets, coined snaps, add-on fasteners, tape, Velcro®, hook and loop materials of adhesive, and glue.

20. The liner system of claim 1, wherein the lower section is at least partially inflated primarily for fit.

21. The liner system of claim 1, further including one or more drainage locations in one or more energy absorbing modules.

* * * * *